United States Patent [19]

Amakasu et al.

[11] 4,247,223

[45] Jan. 27, 1981

[54] ROCK BOLT

[75] Inventors: Toshinari Amakasu; Koetsu Fukui, both of Nara; Yoshito Seto, Yamato Koriyama, all of Japan

[73] Assignee: Kubota, Ltd., Osaka, Japan

[21] Appl. No.: 945,817

[22] Filed: Sep. 26, 1978

[30] Foreign Application Priority Data

Sep. 20, 1977 [JP] Japan ..... 52-118041

[51] Int. Cl.[3] ..... E21D 20/02

[52] U.S. Cl. ..... 405/259; 405/260

[58] Field of Search ..... 405/259, 260, 261; 85/1 JP, DIG. 2

[56] References Cited

U.S. PATENT DOCUMENTS

| | | | |
|---|---|---|---|
| 3,306,051 | 2/1967 | Howlett | 405/260 |
| 3,316,797 | 5/1967 | Williams | 405/260 |
| 3,379,019 | 4/1968 | Williams | 405/260 |

FOREIGN PATENT DOCUMENTS

| | | | |
|---|---|---|---|
| 556327 | 4/1958 | Canada | 85/DIG. 2 |
| 84938 | 1/1955 | Norway | 405/260 |

*Primary Examiner*—David H. Corbin

*Attorney, Agent, or Firm*—Joseph W. Farley

[57] ABSTRACT

A rock bolt to be inserted into a bore formed in the ground from the inner periphery of a tunnel and anchored to the ground with grout filled in the space in the bore around the bolt to reinforce the ground. The rock bolt has two grooves extending axially thereof and an elastic tubular member fixedly fitting around the bolt close to one end thereof. A tube having an opening close to the other end of the bolt is provided within one of the grooves. Another tube provided in the other groove has an opening close to one end of the tubular member remote from the above-mentioned one end of the bolt. Before the injection of the grout, the rock bolt can be fixed to the ground easily and reliably by pressing the elastic tubular member into the bore. The grout is filled into the space through one of the tubes while displacing air through the other tube.

3 Claims, 9 Drawing Figures

ROCK BOLT

The present invention relates to a rock bolt to be inserted in a bore formed in the inner periphery of ground defining a tunnel (hereinafter referred to merely as "ground") and anchored to the ground by the bond of grout filled in the space in the bore around the bolt to reinforce the ground.

The known rock bolts to be anchored in the ground with grout include:

(a) a rock bolt 21 comprising a rod twisted in the form of a helix as shown in FIG. 1, and (b) a rock bolt 31 as shown in FIG. 2 and comprising a rod 33 having a channel 32 extending axially therethrough, a tubular cone 34 screwed on one end of the rod 33 and having a truncated conical outer periphery, a tubular expansion shell 35 fitting around the cone 34 and having a truncated conical inner periphery and an axial cut, and a ring 36 mounted on the rod 33 for preventing the axial movement of the expansion shell 35.

With the rock bolt 21 mentioned under (a) above, hard-kneaded mortar 22 and a capsule 23 containing a rapid-hardening binder are placed into a bore in the ground. The rock bolt 21, when thereafter inserted into the bore, ruptures the capsule 23 with its forward end, reacting the binder with the mortar 22 to harden the mortar and thereby anchor the bolt 21 in the ground. However since the mortar 22 requires some time for hardening and holds the rock bolt 21 to the ground with its viscosity before hardening, the bolt can not be anchored reliably with stability.

In the case of the rock bolt 31 given under (b) above, the rod 33 is rotated with the rock bolt 31 placed in the bore in the ground, thereby moving the cone 34 axially thereof and diametrically expanding the shell 35 into pressing contact with the bore-defining wall surface to anchor the bolt 31 to the ground. Grout is filled into the bore through a tube 37 placed therein through the clearance around the bolt 31 while displacing air through the channel 32, whereby the rock bolt 31 is fixed in the ground. The rock bolt 31 therefore has the drawback of being inefficient to use because of the necessity of driving the rod 33 to diametrically expand the shell 35.

In view of the above problems, the main object of this invention is to provide a rock bolt which can be fixed to the ground reliably and easily and which permits effective injection of grout and displacement of air.

Other features of the present invention will be understood from the description of preferred embodiments given with reference to the accompanying drawings, in which.

Figure 1:
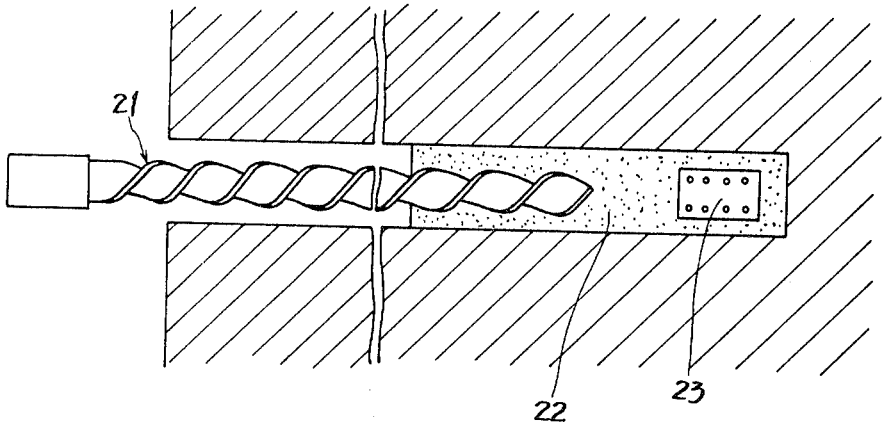
FIGS. 1 and 2 are sectional views partly broken away and showing conventional rock bolts.
Figure 2:
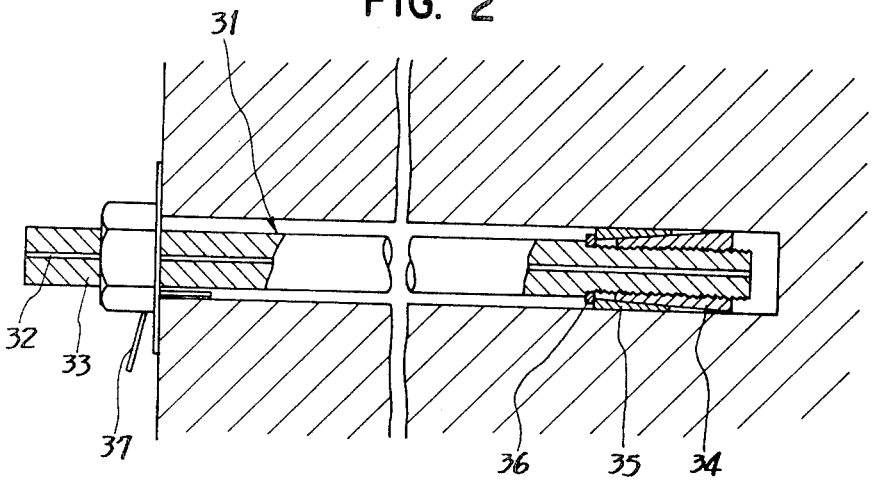
Figure 4:
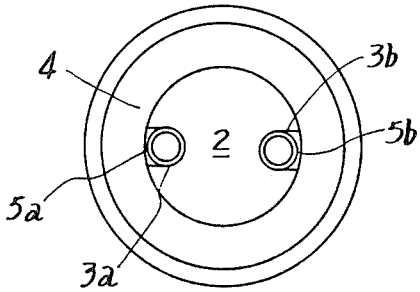
FIG. 4 is an enlarged view of the same as it is seen in the direction of the arrow IV in FIG. 3.
Figure 3:
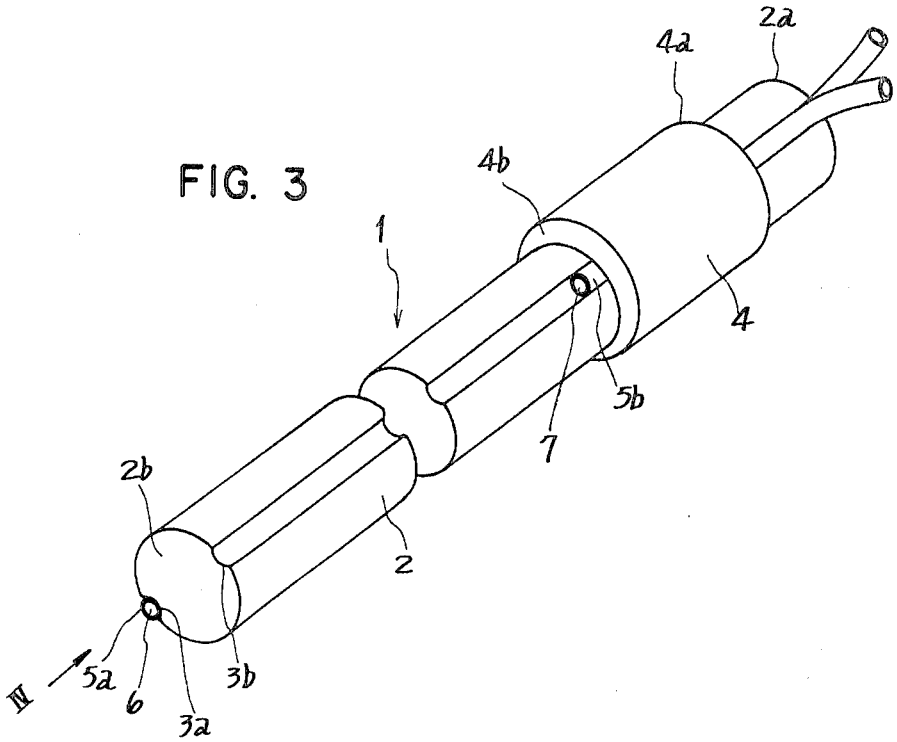
FIG. 3 is a perspective view showing a rock bolt according to the invention.

With reference to FIGS. 3 and 4, a rock bolt 1 comprises a rod 2 made of iron, steel or the like and having two grooves **3*a* and 3*b* extending over the entire length of the rod 2 axially thereof. An elastic tubular member 4 made of hard rubber is fitted around the rod 2 close to one end 2*a* thereof and secured thereto with an adhesive. A tube 5*a* provided within one groove 3*a* of the two 3*a* and 3*b* has an opening 6 close to the other end 2*b* of the rod 2 and extending at least to the end 2*a* of the rod 2. Another tube 5*b* provided within the other groove 3*b* has an opening 7 close to one end 4*b* of the elastic tubular member 4 which end is positioned closer to the other end 2*b* of the rod 2 than the end 4*a* thereof, the tube 5*b* extending at least to the end 2*a* of the rod 2. The tubes 5*a* and 5*b* are made of flexible synthetic resin or rubber and are secured to the grooved portions 3*a* and 3*b* with an adhesive or retained therein against displacement with bands. The rod 2** can be furnished with a deformed surface to enable grout to adhere thereto effectively.

The tubular member 4 has an inside diameter equal to the outside diameter of the rod 2 or smaller than the outside diameter by up to 0.5 mm so as to fit to the rod 2 without leaving any clearance. The fitting portions are joined together with a two-component epoxy resin adhesive 12 as indicated in FIG. 4. According to the embodiment shown in FIGS. 3 and 4, the tubular member 4 has a truncated conical outer periphery with its outside diameter progressively increasing axially thereof toward the end **2*a* of the rod 2. (See FIG. 5.) FIG. 6 shows another elastic tubular member 4 having ridged or furrowed contours provided by a plurality of annular ribs arranged side by side on the outer periphery of the member axially thereof. The annular ribs have outside diameters progressively increasing from rib to rib in the axial direction toward the end 2*a* of the rod 2**.

Figure 5:
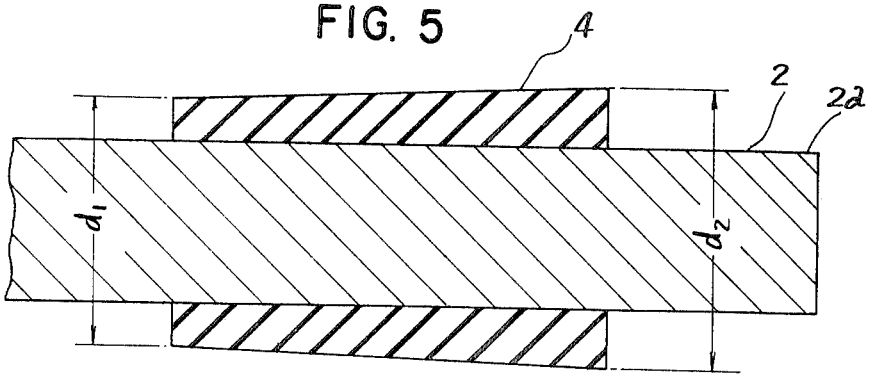
FIG. 5 is a sectional view showing the contour of an elastic tubular member.
Figure 6:
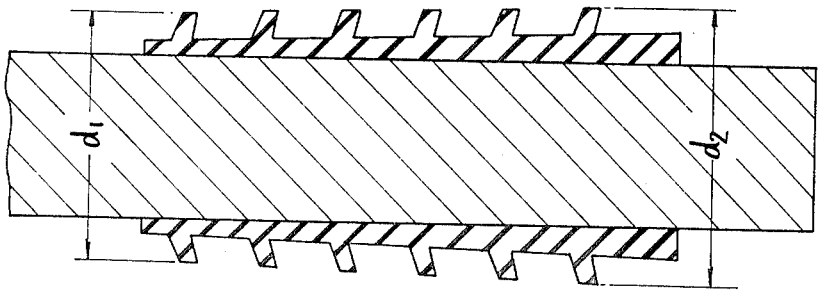
FIG. 6 is a sectional view showing the contour of another elastic tubular member.

Assuming that the tubular members 4 shown in FIGS. 5 and 6 have a smaller outside diameter $d_1$ and a larger outside diameter $d_2$ and that the diameter of the bore (usually equal to the outside diameter of the drill used to form the bore) in the ground is D, $d_2 > d_1 > D$, as shown in FIG. 6.

Preferably the grooves **3*a* and 3*b* have a depth equal to or slightly larger than the outside diameter of the tubes 5*a* and 5*b* so that the tubes 5*a* and 5*b* can be fully accommodated within the grooves 3*a* and 3*b* without projecting outward therefrom. This serves to prevent the possible damage to the tubes 5*a* and 5*b* that would otherwise result from the contact of the tubes with the bored wall surface when the rock bolt 1** is inserted into the bore.

Although the grooves **3*a* and 3*b* extend over the entire length of the rod 2 in the foregoing embodiment, the groove 3*b* need not extend over the entire length of the rod 2 but may have such a length that it extends from the end 2*a* of the rod 2 slightly beyond the opening 7 of the tube 5*b***.

Figure 7:
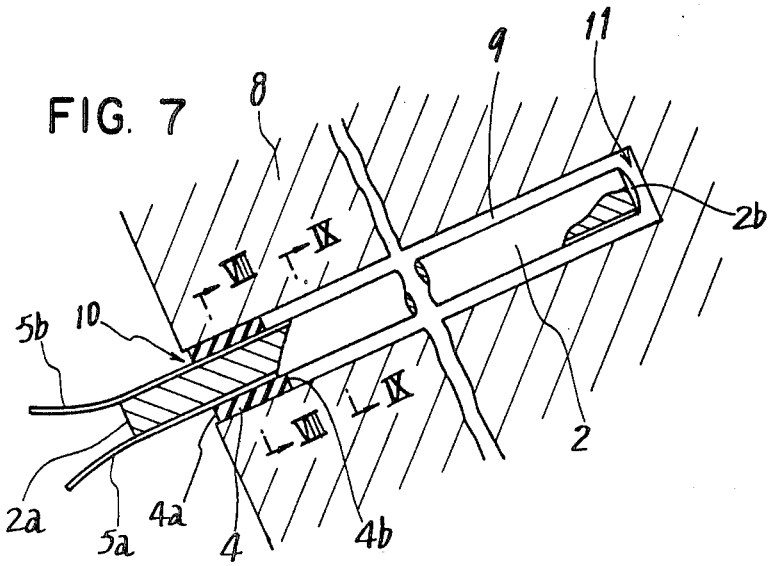
FIG. 7 is a sectional view showing the rock bolt as inserted in a bore in the ground.
Figure 8:
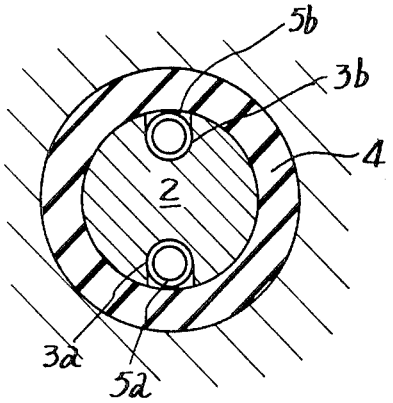
FIG. 8 is a view in section taken along the line VIII—VIII in FIG. 7.
Figure 9:
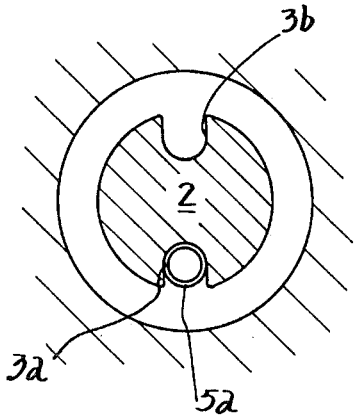
FIG. 9 is a view in section taken along the line IX—IX in FIG. 7.

The rock bolt 1 of this invention will be anchored in the ground in the following manner for use in a bore 9 extending upwardly obliquely in the ground 8 as seen in FIG. 7.

The rock bolt 1 is inserted at the other end **2*b* of the rod 2 into the bore 9. Until the end 4*b* of the tubular member 4 closer to the other end 2*b* of the rod 2 reaches the open portion 10 of the bore 9, the bolt 1 can be inserted smoothly and thereafter encounters resistance. When the bolt is further forced in as by a pneumatic hammer against this resistance, the elastic tubular member 4 is compressed and deformed and held in intimate contact with the bore defining wall surface by the repelling force resulting from the deformation. Despite the compression and deformation of the tubular member 4, the tubes 5***a* and 5*b* which are accommodated within the grooves 3*a* and 3*b* are free from the compressing force and will not be flattened and closed. When the rock bolt 1 has been inserted into the bore 9 to the end 4*a* of the tubular member 4 closer to the end 2*b* of the rod 2, the inserting procedure is completed, with the result that the rock bolt 1 is fixed to the ground 8 by the repelling force of the tubular member 4.

Subsequently grout is injected from one end of the tube 5*b* at the end 2*a* of the rod 2. The grout is forced out from the opening 7 of the tube 5*b* and progressively fills the space of the bore 9 around the rock bolt 1 toward the innermost portion 11 of the bore 1. The air forced toward the innermost portion 11 of the bore 9 by the injected grout is displaced from the bore 9 from the opening 6 through the tube 5*a*. After the grout has filled the bore 9 to the innermost portion 11 where the other end 2*b* of the rod 2 is positioned, the grout flows out from the bore 9 through the tube 5*a*, whereby the completion of the filling operation can be confirmed.

For use in an upwardly extending vertical bore formed in the ground by an excavating drill, the rock bolt will be fixed to the ground in the same manner as above.

When an obliquely downward or vertically downward or horizontal bore is formed in the ground, the rock bolt 1 will be inserted into the bore also in the same manner as above, but the grout is injected through the tube 5*a* from one end 2*a* of the rod while displacing the air from the opening 7 through the tube 5*b* in the reverse relation to the above.

According to the invention described above, the elastic tubular member fixedly fitting around the rod is deformable by being compressed by the force by which the rock bolt is inserted into a bore in the ground, with the result that the tubular member is held pressed against the bore defining wall surface by the repelling force produced by the deformation, thus fixing the rock bolt to the ground effectively. This can be accomplished very easily by merely forcing the bolt into the bore against the resistance encountered. Since the tubes are accommodated within the grooves formed in the rod, the tubes will not be closed even when the tubular member is deformed by compression, consequently assuring injection of the grout and displacement of air with high reliability.

What is claimed is:

1. A rock bolt having an outer end and an inner end adapted to be anchored in a bore in the ground by the injection of grout into the space between the bolt and the bore, the bolt having two longitudinally extending grooves formed in the surface thereof with at least one of said grooves extending between the ends of the bolt, wherein the improvement comprises:

means for fixing the bolt in the bore prior to the injection of grout, said fixing means consisting of an elastic tubular member having concentric inner and outer surfaces;

adhesive means securing said inner surface to the rock bolt close to the outer end thereof;

said concentric outer surface being provided with a series of axially spaced outwardly projecting elastic annular ribs adapted to compressively engage the bore as the rock bolt is inserted therein;

said annular ribs having outside diameters which progressively increase toward the outer end of the rock bolt, the smallest of said progressively increasing diameters exceeding the diameter of the bore;

a tube provided within said one of the two grooves and having an opening close to said inner end of the rock bolt; and another tube provided within the other groove and having an opening close to one end of the tubular member positioned closer to said inner end of the rock bolt, said tubes extending through the tubular member in said grooves.

2. A rock bolt as defined in claim 1 wherein said annular ribs taper towards the inner end of the rock bolt.

3. A rock bolt as defined in claim 1 or 2 wherein said elastic tubular member is made of hard rubber.

* * * * *

UNITED STATES PATENT AND TRADEMARK OFFICE

CERTIFICATE OF CORRECTION

PATENT NO. : 4,247,223

DATED : January 27, 1981

INVENTOR(S) : TOSHINARI AMAKASU ET AL

It is certified that error appears in the above—identified patent and that said Letters Patent is hereby corrected as shown below:

Title Page, under "[75] Inventors:", "Nara" should read -- Nara-ken --; "Yamato Koriyama" should read -- Nara-ken --.

Title Page, under "[30] Foreign Application Priority Data", "Sep. 20, 1977" should read -- Sep. 30, 1977 --.

Signed and Sealed this

*Twelfth* Day of *May 1981*

[SEAL]

*Attest:*

RENE D. TEGTMEYER

*Attesting Officer*

*Acting Commissioner of Patents and Trademarks*